United States Patent [19]

Tanner

[11] 4,023,314

[45] May 17, 1977

[54] MOBILE HOME ANCHOR AND A METHOD FOR EMBEDDING SAME

[76] Inventor: Donald L. Tanner, Rte. 1, Box 16A, Hartford, Mich. 49057

[22] Filed: Oct. 2, 1975

[21] Appl. No.: 618,882

[52] U.S. Cl. ..... 52/23; 61/53.74; 52/162; 52/164

[51] Int. Cl.[2] ..... E04B 7/00; E04D 5/74

[58] Field of Search ..... 52/23, 26, 166, 155, 52/164, 157, 161, 162; 61/53.74, 68; 175/422

[56] References Cited

UNITED STATES PATENTS

| | | | |
|---|---|---|---|
| 912,018 | 2/1909 | McNutt | 52/164 |
| 1,695,523 | 12/1928 | Bilhorn | 61/53.74 |
| 2,343,350 | 3/1944 | Warren | 52/161 |
| 3,012,644 | 12/1961 | Bush | 52/162 |
| 3,017,000 | 1/1962 | Hynds | 52/164 |
| 3,115,226 | 12/1963 | Thompson, Jr. | 52/166 |
| 3,664,139 | 5/1972 | Sexauer | 61/53.74 |
| 3,744,192 | 7/1973 | Burnett | 52/23 |
| 3,750,349 | 8/1973 | Deike | 52/23 |
| 3,866,368 | 2/1975 | Toops | 52/162 |

*Primary Examiner*—Price C. Faw, Jr.
*Assistant Examiner*—Robert C. Farber
*Attorney, Agent, or Firm*—McGarry & Waters

[57] ABSTRACT

An anchor for securing a mobile home or the like in position on the ground comprises a hollow tubular anchor post having locking arms pivotably mounted at a lower end thereof for movement from an entry position wherein the locking arms lie flat against the post to a locking position wherein the locking arms are pivoted downwardly and outwardly from the post. The anchor includes a fluid jet embedding mechanism comprising an inlet for pressurized water at the upper end of the hollow anchor post and an outlet for pressurized water at the lower end of the anchor post. The anchor is embedded in the ground by directing a stream of water under pressure down the interior of the tubular anchor post and directly against the ground beneath the anchor post. This displaces the ground below the anchor and causes the anchor to embed itself firmly into the ground.

15 Claims, 11 Drawing Figures

MOBILE HOME ANCHOR AND A METHOD FOR EMBEDDING SAME

BACKGROUND OF THE INVENTION

1. Field of the Invention

The present invention relates to a self-embedding anchor for securing a mobile home or the like to a solid ground and more particularly to a self-embedding anchor that is embedded into the ground without rotating by means of a fluid jet embedding mechanism.

2. Description of Prior Art

Various anchoring systems have been developed in order to prevent mobile homes and house trailers or the like from being overturned by violent storms and strong winds. Anchoring systems previously developed for this purpose have been expensive and complex and have been difficult and expensive to install, usually requiring trained personnel employing special tools and equipment.

An object to the present invention is to provide an anchoring system that is inexpensive and may be installed easily by a mobile home owner.

SUMMARY OF THE INVENTION

In accordance with the present invention, a self-embedding anchor for securing an object to the ground comprises an elongated anchor post adapted to be inserted into the ground in an axial direction. A locking mechanism is mounted on the exterior of the anchor post and permits the anchor to be inserted in the ground in a first axial direction but prevents removal of the anchor in a reverse direction once the anchor post has been embedded into the ground. A fluid jet embedding means for embedding the anchor post in the ground includes a fluid conduit extending from an inlet at an upper portion of the anchor post to an outlet at the lower end of the anchor post. The fluid jet embedding means discharges pressurized water in a direction directly below the lower end of the anchor post, such the discharged water displaces the ground below the anchor post when the anchor post is placed against the ground. The anchor post is embedded in the ground by moving the anchor post downwardly into the area displaced by the water.

In one aspect of the present invention, the anchor post is a hollow tubular member and the fluid jet embedding mechanism comprises the hollow interior of the tubular member. The tubular member has open upper and lower ends thereof that serve as the inlet and outlet for the fluid jet embedding mechanism.

The anchor post and outlet of the anchor post are formed so that when water is introduced into the interior of the anchor having predetermined pressure, the water will be discharged from the anchor post with sufficient force and velocity to cause an anchor to be substantially self-embedded into the ground when the lower end of the anchor is pressed gently against ground of normal consistency. Desirably, the predetermined pressure at which water is introduced into the anchor post is normal tap water pressure.

The locking mechanism of the present invention includes a plurality of locking arms spaced about the preiphery of the anchor post, with each locking arm being pivotable from an entry position, wherein the locking arm lays flat against the anchor post, to a locking position, wherein the upper or outer end of the locking arm is pivoted downwardly and outwardly from the anchor post to a locking position.

One feature of the present invention is that the locking arms are mounted in pairs on opposite sides of the anchor post, and the inner or lower ends of the locking arms are formed so that they engage each other and restrain further downward movement of the locking arms when the locking arms reach their locking positions. The engagement of the inner ends of the locking arms prevents movement of the locking arms past their locking positions and prevents the hollow anchor post from being crushed or deformed inwardly when an upward force is exerted on the anchor.

In a preferred embodiment of the present invention, each locking arm is mounted on a restraining arm that extends downwardly and outwardly from the anchor post. The restraining arm fits through an opening in each locking arm and has a head on the outer end thereof that prevents movement of the locking arm past its locking position.

In an alternative embodiment, outward movement of the locking arm can be restrained by a stop bar that extends upwardly from a position below the locking arm into position to contact the locking arm when it reaches its locking positon. In still another embodiment a hinge mechanism could be employed to restrain outward movement of the locking arm pass its locking position.

As an alternative to mounting the locking arms on the anchor post by means of the restraining arm itself, the locking arm can be pivotably mounted on the anchor post by means of a simple mounting bracket attaching the inner end of each locking arm to the anchor post. These mounting brackets can be mounted directly on the anchor post or they can be mounted on a separate mounting bracket that encircles the anchor post itself. The separate mounting bracket may be bolted on the anchor post at any desired axial position.

These and other features of the present invention will hereinafter appear, and for purposes of illustration, but not of limitation, preferred embodiments of the present invention are described in detail below and shown in the appended drawings.

DETAILED DESCRIPTION OF PREFERRED EMBODIMENTS

Figure 1:
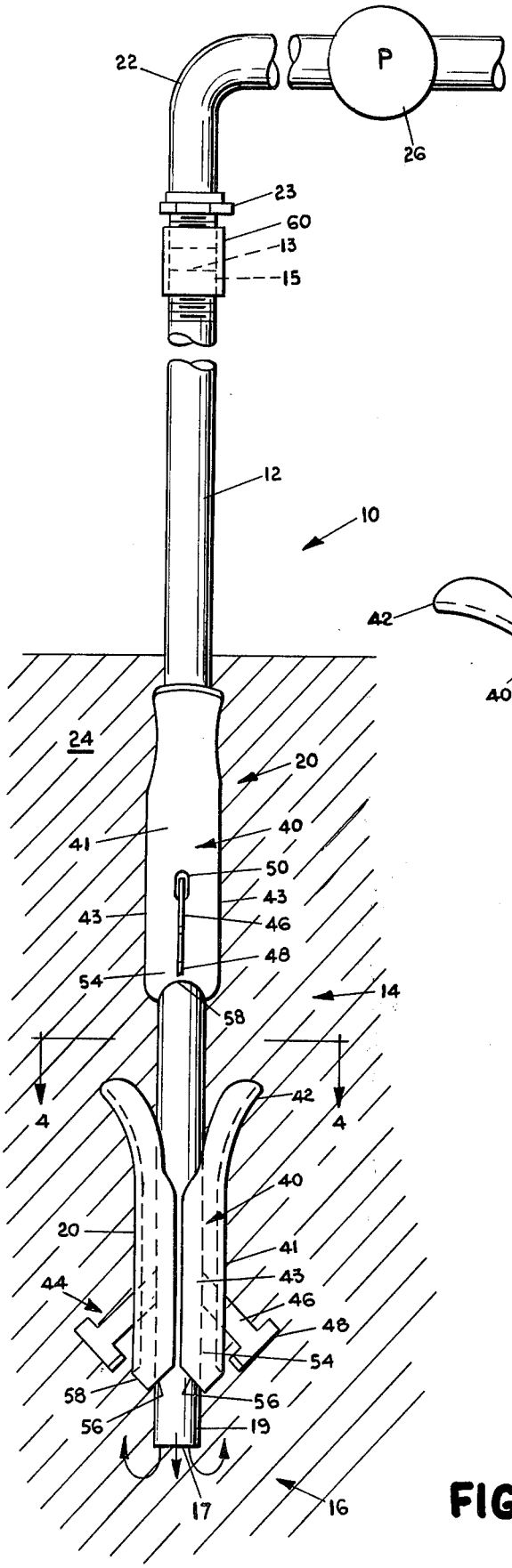
FIG. 1 is a partially broken elevational view showing the anchor of the present invention being embedded into the ground.
Figure 2:
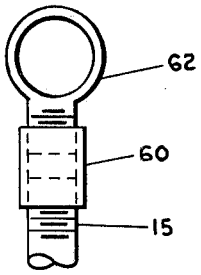
FIG. 2 is a broken elevational view showing the upper end of the anchor of the present invention, with an eye bolt attached to the anchor.

Referring now to the drawings, a mobile home anchor 10 embodying the features of the present invention comprises an anchor post 12, a locking mechanism 14 mounted on the anchor post, and a fluid jet embedding mechanism 16 for embedding the anchor.

Anchor post 12 is a hollow tubular member having an open interior 18. The post comprises an inlet at an upper end 15 thereof and an outlet 17 at a lower end 19 thereof.

Figure 3:
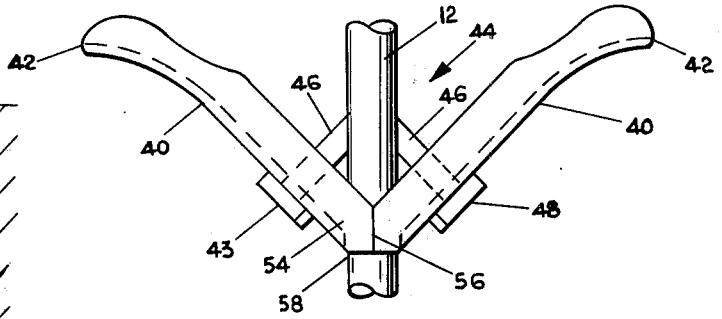
FIG. 3 is a broken elevational view showing the locking arms of the anchor in their locking positions.

Locking mechanism 14 comprises a plurality of locking arms 20 movably mounted on the outside of the anchor post for movement from an entry positon (FIG. 1) to a locking position (FIG. 3). In the entry position the locking arms lay flat against the sides of the anchor post, while in their locking position, the locking arms are pivoted downwardly and outwardly from their entry positions.

The fluid jet embedding mechanism comprises a water conduit leading from an inlet at the upper end of the anchor post to an outlet at the lower end of the anchor post. Desirably, this water conduit is the open interior of the anchor post with the inlet and outlet of the conduit being the open upper and lower ends 13 and 17 of the anchor post.

To embed the anchor of the present invention in the ground, a water hose 22 is attached to inlet 13 at the upper portion of the anchor post and the lower end 19 of the anchor post is placed against solid ground 24. When anchor post 12 is positioned in this manner, the axis of the anchor post faces directly downwardly to the ground, and outlet opening 17 faces directly downwardly into the ground. Hose 22 may be connected to the inlet opening of the anchor post by means of a conventional hose connection fitting 23.

Water at a predetermined pressure is introduced into the interior of the anchor post via hose 22 and inlet opening 13. The water travels downwardly in the anchor post and exits from the anchor post through outlet 17. The diameter of the anchor post and the configuration of outlet opening 17 are selected such that water at a predetermined pressure will be discharged from outlet opening 17 with sufficient force and velocity to displace the ground immediately below the lower end of the anchor post, thereby permitting the anchor post to effectively embed itself in the ground. In a preferred embodiment of the present invention, the anchor post is formed of a one inch of three quarters inch outer diameter cold rolled steel pipe. With a pipe of this size the anchor can be embedded easily into ground of normal consistency (i.e., ground that is substantially less permeable than sand) by means of an ordinary garden hose and water at normal tap water pressure (i.e., about 40 pounds per square inch). In such an embodiment, outlet opening 17 is simply an open lower end of the tubular anchor post. An anchor post formed of pipe having as much as a 2 inch outer diameter can be embedded into the ground at normal tap water pressure, although the embedding action requires more time. A ¾ inch or a 1 inch pipe is sufficiently large for an anchor for a mobile home or the like. Larger pipe might be necessary for securing substantially larger structures.

In determining the measurements and water pressure necessary for the anchor of the present invention to be self-embedding it is contemplated that the ground in which the anchor is embedded will be of a conventional consistency. If the ground consists of a substantial amount of clay or other less permeable material, the same anchor post will still be effectively self-embedding, although the self-embedding action may take somewhat longer, and a slightly greater downward pressure may be necessary in order to displace the soil.

When water is directed downwardly through anchor post 12 and out of the anchor post through outlet 17 directly into contact with the ground, the water displaces the ground directly below the anchor post as the anchor post is pressed gently against the ground. At the same time, a slurry of water and displaced earth is forced upwardly along the outer surface of the anchor post. As the water displaces more and more earth below the anchor post, the anchor post can be gently pushed downwardly into the ground until it becomes fully embedded. The displaced earth is carried upwardly along the side of the tube by the water emanating from outlet 17 and is packed firmly against the outer wall of the anchor post. This further enhances the rigidity with which the anchor is placed in the ground.

In an application where it is desired to increase the water pressure of the embedding water above tap water pressure, a conventional water pump 26 may be employed in order to increase the water pressure in inlet 13.

Figure 4:
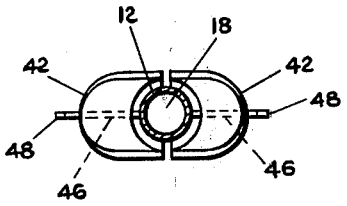
FIG. 4 is a view taken along line 4—4 of FIG. 1.
Figure 5:
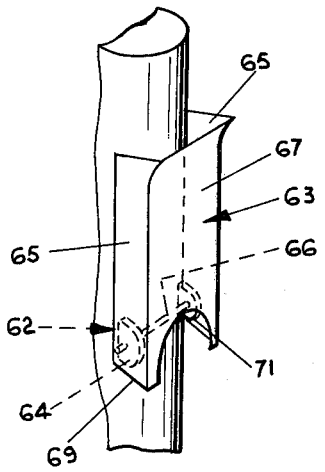
FIG. 5 is a broken perspective view showing a second embodiment of a locking arm.
Figure 7:
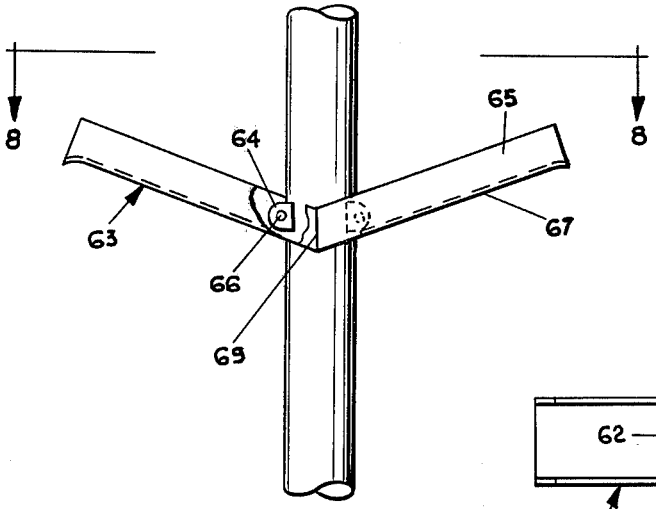
FIG. 7 is a partially broken side elevational view of a section of the anchor of the present invention, showing the locking arms of FIG. 5 in their locked positions.
Figure 8:
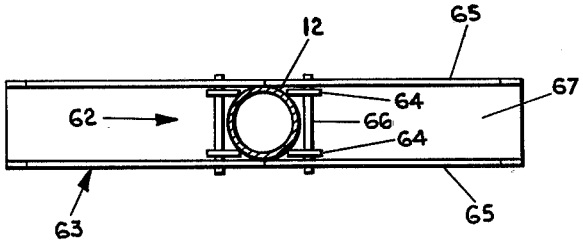
FIG. 8 is a view taken along line 8—8 of FIG. 7.
Figure 9:
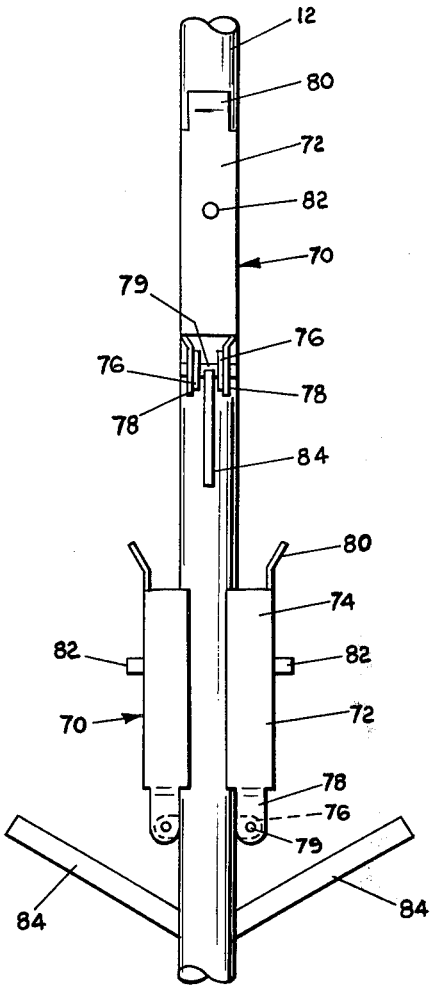
FIG. 9 is a broken elevational view of the anchor of the present invention showing a third embodiment of a locking mechanism, with the locking arms of the locking mechanism being shown in their entry positions.
Figure 10:
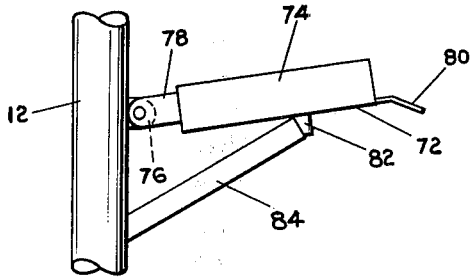
FIG. 10 is a broken elevational view showing one of the locking arms of FIG. 9 in its locking position.
Figure 11:
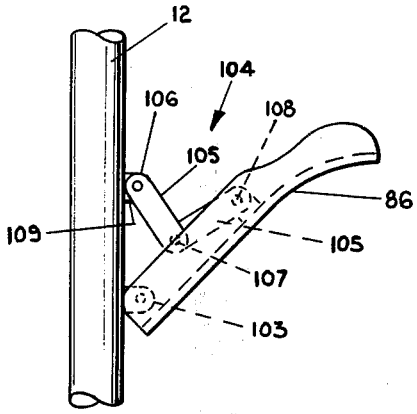
FIG. 11 is a broken elevational view showing a fourth embodiment of a locking arm of the present invention.
Figure 12:
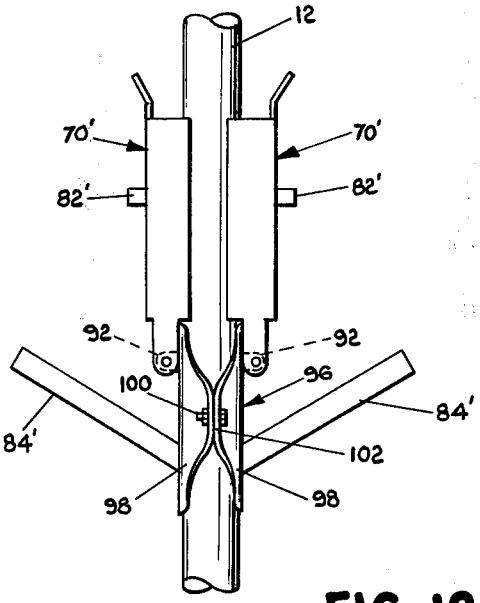
FIG. 12 is a broken elevational view showing a fifth embodiment of a locking arm of the present invention.

Several different embodiments of locking mechanisms are shown in the appended drawings, a first embodiment being shown in FIGS. 1, 3, and 4; a second embodiment being shown in FIG. 5, 7, and 8; a third embodiment being shown in FIGS. 9 and 10; a fourth embodiment being shown in FIG. 11; and a fifth embodiment being shown in FIG. 12. All of these locking mechanisms have in common the fact that they include movable arms positioned on opposite sides of the anchor post. Each arm has an entry position (FIG. 1), wherein the arm lays flat against the anchor post and permits entry of the anchor post into the ground in an axial direction without rotation of the anchor post. Each arm also has a locking position (FIG. 3) wherein the upper end of the locking arm is pivoted downwardly and outwardly from the entry position so that the upper end of the arm extends outwardly from the anchor post. When in this position, the locking arms resist removal of the anchor from the ground with much greater force than the folded arms resisted entry of the anchor into the ground.

Describing each embodiment in more detail, in the first embodiment shown in FIGS. 1, 3, and 4, a pair of locking arms 40 are mounted on opposite sides of the anchor post at the same axial position on the post. Each locking arm is a curved member having a back portion 41 and sides 43 that fit around the sides of the anchor post. Each arm has a outwardly flared outer or upper end 42, which is shaped so that it engages earth and causes the arms to be pivoted downwardly and outwardly from its locking position as the anchor is pulled in an upward direction out of the ground.

Each locking arm 40 is mounted to the anchor post by means of a movement limiting mechanism 44 comprising a flat restraining arm 46 extending downwardly and outwardly from the anchor post and a head 48 mounted on the outer end of the restraining arm. The restraining arm fits through a slot or opening 50 in the back portion 41 of the locking arm, and head 48 prevents the locking arm from moving outwardly past its locking position at the end of the restraining arm. The head is sloped so that it urges the locking arm to slope upwardly and outwardly as it rests on the head of the restraining arm.

The inner or lower end 54 of each locking arm is formed so that when opposed locking arms are pivoted to their locking positions, the inner ends of the locking arms engage each other and resist the inward force that would otherwise be exerted solely on the anchor post itself when an upward force is exerted on the anchor. To accomplish this purpose, the sides of the inner end of each locking arm include beveled surfaces 56 that engage and mate with similarly beveled surfaces on the sides of the inner end of the locking arm on the opposite side of the anchor post when the locking arms reach their locking positions. The back portion of the end of each locking arm includes an arcuate recessed area 58 that fits snugly over the anchor post and engages the anchor post when the locking arm is pivoted to its locking position. Recessed area 58 prevents the inward force on the inner ends of the locking arms from being exerted on the anchor post at least until the beveled surfaces 56 are in engagement. Preferably, when the locking arm is in its locking position, inward force on the locking arm is resisted simultaneous by engagement of the beveled surfaces on the sides of opposed arms and engagement of the recessed area 58 with the anchor post.

The shape of the inner ends of the locking arms is important in the context of the present invention, because it prevents the tubular anchor post from being crushed or deformed inwardly when an upward force is exerted on the anchor. With a solid anchor post, the problem might not arise, but with a fluid jet embedding mechanism and a hollow anchor post, a strong upward force on the anchor might deform the anchor post inwardly without the improved construction described herein.

Figure 6:
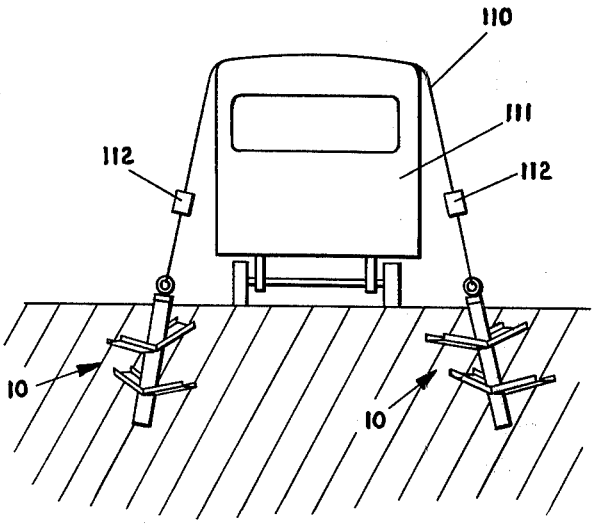
FIG. 6 is a pictorial view showing the use of the anchor of the present invention in securing a mobile home or the like to the ground.

The upper end 15 of post 12 is externally threaded and receives a coupling 60 which is internally threaded at each end thereof. The outer end of coupling 60 is adapted to receive either a conventional water coupling 23 for jetting the anchor into the ground or an eye bolt 62. Eye bolt 62 is used when the anchor is fully embedded into the ground and the anchor is attached to a restraining strap for holding a mobile home or other object to the ground (as shown in FIG. 6).

In a second embodiment of the present invention, shown in FIGS. 5, 7, and 8, a locking arm 63 formed in the shape of a channel member havng parallel sides 65 and a flat back portion 67. Locking arm 63 is mounted on the anchor post by means of a mounting bracket 62 attached to the outer portion of the anchor post. Mounting bracket 62 comprises two parallel ears or clips 64 that extend outwardly from the side of the anchor post. A pin 66 extends between openings in the clips and through openings 68 in the sides of locking arm 63. Locking arm 63 fits over clips 64 and is pivotably mounted on pin 68 for movement for its entry to its locking position.

As shown in FIG. 7, the lower ends 69 of the sides of locking arm 63 are beveled in the same manner as the first embodiment described above, so that the lower ends of the locking arms resist inward force on the anchor post, instead of the anchor post bearing the full force. The lower end 71 of the back portion of the locking arm includes an arcuate recessed area that permits the locking arm to pivot downwardly until the the lower ends of the locking arm engage. The arcuate back portion of the locking arm may be formed so that it engages the anchor post at the same time as the lower ends of the sides engage each other, so that both anchor post and the lower sides resist inward force. However, the engagement of the back portion with the anchor post is designed so that the anchor post itself is not deformed inwardly as a result of upward force on the anchor.

In the third embodiment of the present invention, shown in FIGS. 9 and 10, each locking arm 70 comprises a flat back portion 72 and parallel sides 74 extending at right angles from the back portion around anchor post 12. The inner end of locking arm 70 is pivotably mounted to a pair of spaced clips 76 extending outwardly from the anchor post, the inner end of the locking arm including spaced legs 78 that fit over the clips. An axle 79 may extend through aligned openings in legs. An outwardly flared lip 80 on the outer end of locking arm 70 ensures that the locking arms pivot outwardly and downwardly when the anchor post is moved upwardly after it has been fully inserted into the ground.

The principal difference between the third embodiment of the present invention and the other embodiments described above is that the means for stopping the downward movement of the locking arm at its locking position is provided by means of a stop projection 82 on the outer surface of the back portion of the locking arm and a stop bar 84 that extends upwardly and outwardly from the anchor post from a position directly below the locking arm on the anchor post. As shown in FIG. 10, stop bar extends upwardly so that when the locking arm is pivotably downwardly to its locking position, stop bar 84 engages the back portion of the locking arm and stop projection 82 and prevents further downward rotation of the locking arm.

In the fifth embodiment of the present invention, as shown in FIG. 12, locking arms 70′ are substantially the same manner as locking arms 70. Locking arms 70′ similarly include stop projections 82′ on the outer side thereof, and these stop projections engage stop bars 84′, substantially in the same manner as the stop bars and stop projections shown in FIGS. 9 and 10.

The principal difference between this embodiment and the one described above, is that the mounting clips 92 on which the locking arms are pivotably mounted are not themselves attached to the anchor post. Instead, the mounting clips are mounted on a bracket 96 that encircles the anchor post. Bracket 96 is formed into opposed sections 98, which are fastened together by means of a fastener 100 or the like. Fastener 100 extends through openings in flanges 102 which extend outwardly from abutting edges of sections 98.

The use of a separate mounting bracket 96 for the locking arms permits adjustment of the position of the locking arms longitudinally along the anchor post. It also permits the use of different types of locking arms on a given anchor post, in the event that different types of locking arms are found to be more desirable for different types of soil conditions.

In the fourth embodiment, shown in FIG. 11, locking arm 86 is mounted on anchor post 12 by means of spaced clips 103, substantially the same as clips 76 shown in FIG. 9. Locking arm 86 is curved in the same manner as locking arm 40 of FIG. 1. In this embodiment, the outward movement of the locking arm is limited by means of a hinge mechanism 104. Hinge mechanism 104 includes a pair of links 105 pivotably connected together at junction 107. The inner end 106 of the hinge mechanism is pivotably attached to the anchor post by a bracket 109, and the outer end 108 of the hinge mechanism is pivotably attached to the locking arm 86. Hinge mechanism 104 permits the locking arm to move from a generally vertical entry position to an outwardly extending locking position but prevents the locking arm from pivoting downwardly past its locking position.

In all of the above described embodiments, the locking position of the locking arm is such that the locking arm extends upwardly and outwardly from the anchor post when in its locking position. This angular position of the locking arm enhances the locking ability of the locking arm once the anchor has been embedded in the ground.

In the preferred practice of the present invention, two sets of locking arms are used in order to lock the anchor in position in the ground. Each set of arms includes two arms mounted on opposite sides of the anchor posts at the same axial position along the anchor post. The two sets of arms are displaced axially from one another, and one of the sets of arms is displaced radially by 90° from the other set. Thus, the anchor includes four arms disposed 90° apart about the periphery of the anchor post. This maximizes the locking force of the anchor and the amount of earth that must be displaced in order to dislodge the anchor from the ground.

The manner in which the anchor of the present invention is employed in order to secure a mobile home in position in the ground is shown in FIG. 6. Separate anchors 10 are first embedded in the ground on each side of the mobile home by jetting water through the hollow anchor post in the manner described above. The water coupling is then removed and an eye bolt is attached to the upper end of the anchor. A restraining strap 110 is passed over the top of mobile home 111 and connected to the eye bolt on the upper end of each anchor. Turnbuckles 112 in restraining strap 110 are tightened. As turnbuckles are tightened, the anchors are partially withdrawn from the ground. This causes the locking arms to pivot outwardly from their entry to their locking positions. When the locking arms reach their locking positions, the locking arms strongly resist further outward movement of the anchors from the ground, thus, holding the mobile home firmly in position.

It should be understood that the embodiments disclosed herein are merely exemplary of the preferred practice of the present invention and that various changes and modifications could be made in the arrangements and details of construction of the embodiments disclosed without departing from the spirit and scope of the present invention.

The embodiments of the invention in which an exclusive property or privilege is claimed as follows:

1. A self-embedding mobile home anchor for securing a mobile home to solid, dry ground comprising:

an elongated anchor post comprising a hollow pipe having upper and lower ends;

at least one pair of locking arms mounted on the pipe on opposite sides thereof, each locking arm having an inner and outer end and being pivotably movable on the outside of the anchor post from an entry position, wherein the locking arm lays flat against the anchor post with its outer end extending upwardly, to a locking position, wherein the locking arm is pivoted downwardly and outwardly from its entry position with the outer end of the locking arm extending outwardly from the anchor post;

movement limiting means for preventing the locking arm from pivoting outwardly and downwardly past its locking position, said movement limiting means including the inner ends of the locking arms, said inner ends being formed such that when the arms are pivoted downwardly and outwardly to their locking positions, at least a portion of the inner end of each arm fits over the outside of the anchor post and engages the same portion of the other locking arm, engagement of the inner ends of the locking arm preventing further downward and outward pivotal movement of the arms past their locking positions and preventing inward force on the locking arms from deforming inwardly the hollow pipe, said locking arms including lip means on the outer ends thereof for causing the locking arms to pivot from their entry to their locking positions when the anchor is embedded in the ground and an upward force is exerted on the anchor; and means for receiving water under pressure in the open upper end of the anchor post, said water being directed downwardly through the anchor post and discharged from the lower end thereof so as to embed the anchor in the ground.

2. A self-embedding anchor according to claim 1 wherein the inner ends of the locking arms are formed such that they engage each other when the arms are pivoted downwardly to their locking positions but do not press inwardly against the sides of the anchor post at least until the inner ends contact each other.

3. A self-embedding anchor according to claim 2 wherein the movement limiting means includes a separate restraining arm for each locking arm, each restraining arm being mounted at an inner end to the anchor post and extending downwardly and outwardly from the anchor post through an opening between the ends of a locking arm to an outer end, the outer end including a head means that prevents the locking arm from being removed from the restraining arm over the head, the locking arm being slidably mounted for movement along said restraining arm in moving from its entry to its locking positions, the engagement of the lower ends of the locking arms and the engagement of the locking arms with the heads on the restraining arms serving to prevent downward and outward movement of the locking arms past their locking position.

4. A self-embedding anchor according to claim 1 wherein each locking arm comprises a channel member having opposed sides that fit over the outside of the anchor post and a back portion extending between the sides, each locking arm being pivotably attached to the anchor post at a pivot point adjacent the inner end thereof, the inner end of each locking arm comprising inner ends of the portions of the sides that fit over the outside of the anchor post, said inner ends engaging the inner ends of the sides of the locking arm on the opposite side of the anchor post when both locking arms have been pivoted outwardly to their locking positions, the engagement of said inner ends resisting any inward force on the locking arms and preventing inward deformation of the hollow anchor post.

5. A self-embedding anchor according to claim 4 wherein the back portion of the locking arm adjacent the inner end of the locking arm is recessed such that when downward pressure is placed on the outer ends of the locking arms with the locking arms in their locking positions, a sufficient amount of the resultant inward force on the inner ends of the locking arms is restrained by the engagement of the inner ends of the opposing locking arms to prevent the inner ends of the locking arms from engaging and collapsing inwardly the tubular anchor post.

6. A self-embedding mobile home anchor for securing a mobile home to solid, dry ground that is substantially less permeable than sand comprising:

an elongated anchor post comprising a hollow pipe having open upper and lower ends, the upper end including coupling means for releasably attaching a water hose thereto, the diameter of the pipe being sufficiently small such that the anchor will be substantially self-embedding in solid, dry ground that is substantially less permeable than sand when water at conventional tap pressure of about 40 pounds per square inch or greater is introduced into the upper end of the pipe and the lower end of the pipe is placed against the ground;

a plurality of locking arms pivotably mounted on the outside of the pipe, each locking arm having an inner and outer end and being pivotably movable from an entry position wherein the locking arm lays flat against the pipe with its outer end extending upwardly, to a locking position, wherein the locking arm is pivoted downwardly and outwardly from its entry position and the outer end extends outwardly from the pipe, said locking arms including means on the outer ends thereof for causing the arms to pivot from their entry to their locking positions when the anchor is embedded in the ground and the anchor is lifted upwardly in the ground; and movement limiting means for preventing each locking arm from pivoting outwardly and downwardly past its locking position.

7. A self-embedding anchor as claimed in claim 6 wherein the anchor post comprises a conventional cast iron pipe having an outside diameter of approximately ¾ to 1 inch.

8. A self-embedding anchor according to claim 6 wherein the locking arm is pivotably mounted to the anchor post at a pivot point adjacent the inner end thereof and the movement limiting means comprises a stop bar that extends from the anchor post at a position below the locking arm to a position adjacent the locking position of the locking arm, the locking arm engaging and being prevented from further downward pivotal movement when it reaches its locking position.

9. A self-embedding anchor according to claim 6 wherein the locking arm is pivotably mounted to the anchor post at a pivot point adjacent the inner end thereof and the movement limiting device comprises a foldable hinge mechanism havng a first end attached to the anchor post at a point above the pivot point and a second end attached to the locking arm at a position spaced apart from the pivot point on the locking arm and between said pivot point and the outer end of the locking arm.

10. A self-embedding anchor according to claim 6 wherein the locking means includes at least one pair of locking arms mounted at the same axial position on opposite sides of the anchor post, said locking arms being mounted on a bracket that fits over the anchor post, the bracket including fastening means for attaching the bracket and locking arms at any desired position along the anchor post.

11. A self-embedding anchor according to claim 6 wherein the inlet means is an open upper end of the tubular member, said upper end comprising internally threaded coupling means for removably attaching either an externally threaded hose fitting for a water supply or fastening means for securing the mobile home to the anchor, said fastening means comprising an eye-bolt having an externally threaded fitting that is attachable to the internally threaded coupling means.

12. Tie down means for securing a mobile home or the like in a fixed position on solid, dry ground comprising:

first and second self-embedding anchors mounted in the ground on each side of the mobile home, each anchor comprising:

a hollow tubular anchor post having an open interior, said anchor post having inlet means at an upper end thereof for admitting water under pressure into the interior of the post and having outlet means in the lower end thereof for discharging said water from the interior of the post, the outlet means directing the water directly downwardly from the said lower end in a direction in line with the axis of the post, the outlet means causing the water to be discharged with sufficient force and velocity to displace ground of normal consistency when the lower end of the anchor post is placed against said ground, the inlet means comprising a threaded coupling on the open upper end of the anchor post, the coupling being formed to receive a threaded fitting of a conventional water hose;

locking means attached directly to the outside of the post, said locking means permitting the insertion of the post in the ground in an axial direction without rotating, lower end first, said locking means preventing the removal of the post in a reverse direction once the post has been embedded in the ground, said locking means comprising a plurality of pairs of locking arms mounted on opposite sides of the posts, the locking arms being pivotably mounted on the post for movement in a downward and outward direction from an entry position, wherein the arms lay flat against the post, to a locking position, wherein the arms extend outwardly from the post, the lower ends of each pair of arms being formed to engage each other when the locking arms reach their locking positions, said engagement serving to prevent inward force on the locking arms from deforming the hollow anchor post inwardly and to prevent the locking arms from pivoting downwardly past their locking positions, said locking arms including means for pivoting the locking arms from their entry to their locking positions when the anchor is embedded in the ground and an upward force is exerted on the anchor; and an eye-bolt threadably attachable to the threaded coupling on the upper end of the post;

cable means for securing the mobile home to the anchor on each side of the mobile home, each cable means being attached to the eye-bolt on each anchor; and turnbuckle means in the cable means for tightening the cable.

13. A method for embedding a mobile home anchor in solid, dry ground that is substantially less permeable than sand, wherein the anchor comprises a hollow post having locking arms mounted thereon that lay against the side of the post when the post is inserted into the ground and thereafter pivot outwardly into locking position when the post is partially removed from the ground, said method comprising directing a jet of water downwardly through the post as the anchor is gently pressed against the ground, the jet of water being directed against the ground with sufficient force and velocity to displace the ground below the anchor and cause the anchor to become embedded in the ground.

14. A method for anchoring a mobile home to solid, dry ground that is substantially less permeable than sand comprising:

attaching a plurality of locking arms to a section of cast iron pipe having an outside diameter of approximately ¾ to 1 inch, said locking arms being mounted on the cast iron pipe such that the arms are pivotable from an entry position, wherein the arms lay flat against the pipe, to a locking position, wherein the arms are pivoted downwardly and outwardly from their entry position and the arms extend outwardly from the pipe, the arms having outwardly flared lips on the outer ends thereof such that the arms will be pivoted from their entry to their locking positions when the anchor is embedded in the ground and then lifted upwardly in the ground;

providing a fitting on the upper end of the pipe for attachment of a conventional water hose thereto;

attaching a conventional water hose to the upper end of the pipe;

introducing water into the pipe through the water hose at conventional tap water pressure of approximately 40 pounds per square inch or more, holding the lower end of the pipe against the ground during this step, such that the discharge of water dislodges the earth below the end of the anchor and causes the anchor to be embedded in the earth;

shutting off the water and disconnecting the hose after the anchor has been sunken to its desired position;

securing a cable between the upper end of the pipe and the mobile home in a manner sufficient to secure the mobile home to the anchor, providing turnbuckle means in the cable for increasing the tension on the cable; and adjusting said turnbuckle means to tighten the mobile home down to the anchor.

15. A method for embedding a land anchor in solid, dry ground that is substantially less permeable than sand, wherein the anchor comprises a post having locking means mounted thereon, the locking means permitting axial movement of the post into the ground without rotation of the post but preventing movement of the post out of the ground once the post has been embedded into the ground, said method comprising directing a jet of water downwardly from the bottom of the post as the post is gently pressed against the ground, the jet of water being directed against the ground at a water pressure of about 40 pounds per square inch or greater, such force being sufficient to displace the ground below the anchor and cause the anchor to become embedded into the ground.

* * * * *